United States Patent [19]

Gabriel

[11] Patent Number: 4,638,951

[45] Date of Patent: Jan. 27, 1987

[54] ADJUSTABLE POWDER SPRAY NOZZLE

[75] Inventor: Alexander Gabriel, Northfield, Ohio

[73] Assignee: Nordson Corporation, Amherst, Ohio

[21] Appl. No.: 732,381

[22] Filed: May 9, 1985

[51] Int. Cl.[4] ..... B05B 1/32; B05B 5/00

[52] U.S. Cl. ..... 239/707; 239/451; 239/538; 239/579

[58] Field of Search ..... 239/79, 85, 697, 698, 239/704–708, 451, 455, 456, 457, 460, 537, 538, 569, 579; 251/212

[56] References Cited

U.S. PATENT DOCUMENTS

| | | | |
|---|---|---|---|
| 311,720 | 2/1885 | Callahan | 251/212 |
| 1,161,437 | 10/1915 | Beamer et al. . | |
| 1,170,046 | 2/1916 | Carleton . | |
| 1,437,423 | 12/1922 | Jackson . | |
| 2,366,264 | 1/1945 | James | 239/455 |
| 2,587,704 | 3/1952 | Debo . | |
| 3,435,804 | 4/1969 | Orlowski . | |
| 4,169,560 | 10/1979 | Vohringer | 239/698 |
| 4,216,915 | 8/1980 | Hengartner et al. | 239/698 |
| 4,307,840 | 12/1981 | Schulze et al. | 239/451 |
| 4,380,320 | 4/1983 | Hollstein et al. | 239/697 |

*Primary Examiner*—Andres Kashnikow

*Attorney, Agent, or Firm*—Wood, Herron & Evans

[57] ABSTRACT

An adjustable pattern powder spray nozzle assembly comprising a nozzle body having an axial powder flow passage extending therethrough and a pair of rotatable adjacent shafts extending across the powder flow passage. The shafts are in contact with each other substantially along their length and each has a slot formed in the periphery thereof. The slots are oppositely positioned so as to define a powder flow opening therebetween. The shafts are interconnected by gears at the ends thereof so that they are rotatable in unison to vary the configuration of the opening and thereby, the pattern of powder sprayed from the nozzle assembly.

8 Claims, 7 Drawing Figures

ADJUSTABLE POWDER SPRAY NOZZLE

This invention relates to powder spray equipment and more particularly to a powder spray gun having an improved nozzle for applying solid particulate powder material to a target substrate.

In the application of solid particulate material, such as powdered paints, in industrial finishing applications, a powder material is commonly conveyed to a spray gun by air under pressure and is then dispensed from the gun in the form of a powder entrained air stream which is projected from the gun toward an object to be coated or painted. As the powder material is dispensed from the gun, the powder particles are quite often imparted with an electrical charge so that they may be electrostatically attracted toward the object to be coated which is held at electrical ground potential. After coating, the object or target substrate is generally moved into an oven where the powder coating material is heated and melted onto the target substrate.

In one form of prior art electrostatic powder spray gun, a mechanical deflector is mounted at the nozzle end of the gun. The deflector extends into the flow path of powder being emitted from the gun and deflects the powder into a conical spray pattern. That is, the deflector is impacted by the powder coating material being emitted from the gun and directs the powder radially outwardly to form a conical spray pattern. In order to vary the pattern, it has been prior art practice to move a sleeve which surrounds the deflector relative to the deflector, or alternatively to move the deflector relative to the fixed surrounding sleeve. In either event though, the adjustability of the pattern emitted from the gun is minimal and permits of no departure from a conical spray pattern. In many applications though a departure from such a pattern would be desirable but has heretofore been unobtainable.

In yet another style of prior art powder spray gun, of which U.S. Pat. No. 4,380,320 to Hollstein, et al is illustrative, an annular pattern of air entrained powder is emitted from the gun and is impacted by a radially outwardly directed air stream to create a conically shaped pattern of powder discharged from the gun. In this type of gun, a sleeve surrounding the annular pattern of powder emitted from the gun is longitudinally adjustable so as to enable the pattern of powder discharged from the gun to be varied but here again, the adjustment is minimal and permits of no variance from a conical spray pattern.

It has therefore been an objective of this invention to provide a powder spray gun having a nozzle which facilitates wide variance in the size and configuration of pattern emitted from the gun.

It has been still another objective of this invention to provide a powder spray gun nozzle which facilitates changes from one pattern to another and which permits of adjusting the size and configuration of that pattern.

These objectives are achieved according to the practice of this invention by an adjustable pattern spray nozzle assembly adapted to be mounted directly upon the barrel of a powder spray gun. This assembly comprises a body having an axial powder flow passage; and a pair of parallel shafts extending across the powder flow passage of the body. These shafts are located in tangential juxtaposition within the body and having mating slots defined in the periphery thereof so as to define a powder flow opening therebetween. The ends of the shafts are interconnected by spur gears so that they rotate in unison such that manual rotation of one shaft effects rotation of both and thereby an adjustment of the size of the powder flow opening defined between the two shafts.

In operation, fluidized powder coating material passes through the barrel of the gun and through the axial powder flow passage of the nozzle body into and through the powder flow opening defined by the slots in the parallel shafts which extend transversely across the powder flow passage. The fluidized powder then emerges from the powder flow opening defined between the shafts and passes out of the powder discharge orifice of the nozzle assembly onto the object being sprayed by the gun.

One advantage of this nozzle assembly is the ease with which it facilitates adjustments of the powder spray pattern emitted from the nozzle assembly. Such adjustment involves no more than rotating one end of one of the shafts and thereby effecting simultaneous rotation of both shafts in opposite directions so as to vary the configuration of the powder flow opening defined therebetween.

Another advantage of this adjustable nozzle assembly is the ease with which it enables completely different powder spray patterns to be sprayed from the nozzle asssembly. This is accomplished by simply removing an assembly pin which retains the shafts in the nozzle body and replacing the two shafts with two other shafts having a completely differently configured peripheral slot for generating a completely different powder spray pattern in the powder discharged from the nozzle assembly.

Still another advantage of this invention is the relatively few parts embodied in the nozzle assembly for effecting adjustment of the powder spray pattern emitted from the nozzle. Because there are so few parts, the nozzle assembly is easily maintained and/or repaired and is relatively inexpensive to manufacture.

These and other objects and advantages of this invention will be more readily apparent from the following description of the drawings in which.

Figure 1:
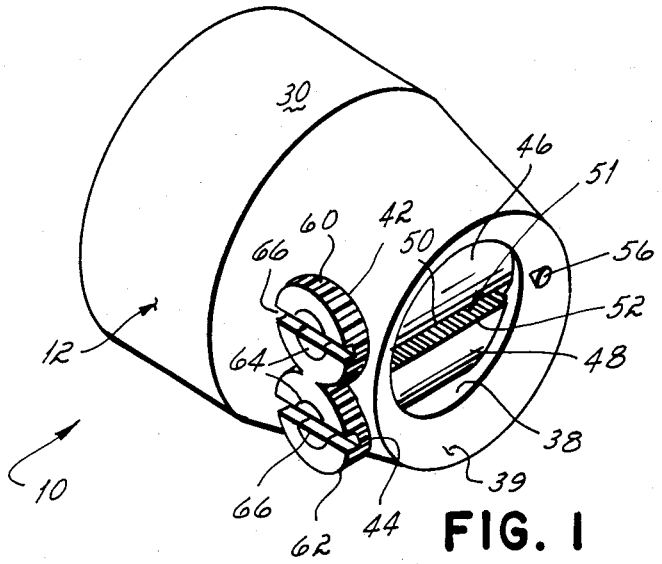
FIG. 1 is a perspective view of an adjustable powder spray nozzle incorporating the invention of this application.
Figure 2:
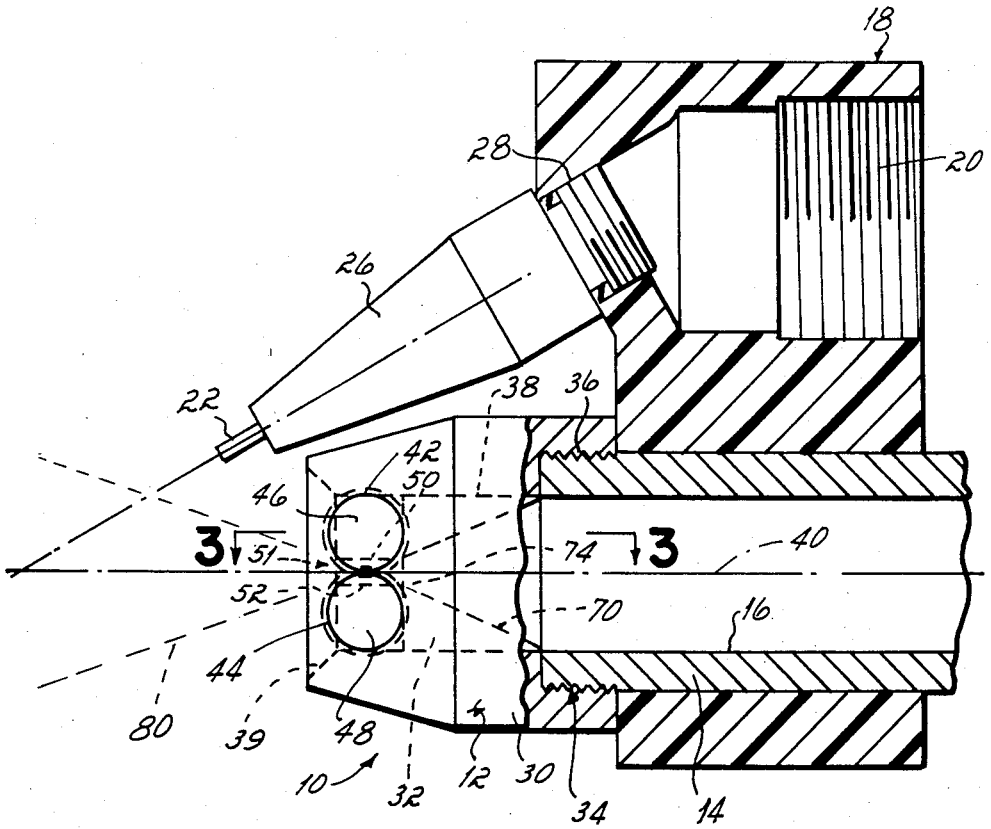
FIG. 2 is a side elevational view, partially broken away, of the end of a powder spray gun having the nozzle assembly of FIG. 1 attached thereto.

With reference to FIGS. 1 and 2, it will be seen that the nozzle assembly 10 of this invention comprises a nozzle body 12 adapted to be secured onto the end of a powder spray gun barrel 14. The barrel 14 is tubular in configuration and has a central powder flow passage 16 through which air entrained powder is transmitted under pressure to and through the nozzle assembly 10.

In the presently preferred embodiment, mounted over the barrel 14 of the gun inboard from the nozzle assembly 10, there is an electrode mount 18. This mount has a rearwardly facing threaded bore 20 formed therein and adapted to receive one end of an electrical connector (not shown) through which electrical power is supplied to an electrode 22 extending from the front of the electrode mount 18. The electrode 22 is mounted within an electrode holder 26 which is threaded at its rearward end into a threaded bore 28 in the electrode mount 18. The bore 28 angularly intersects the threaded bore 20 of the mount.

An electrical contact (not shown) in the rear of the holder 26 is adapted to electrically connect the rearward end of the electrode 22 to the forward end of an electrical connector (not shown) mounted within the bore 20 of the electrode mount 18.

Figure 3:
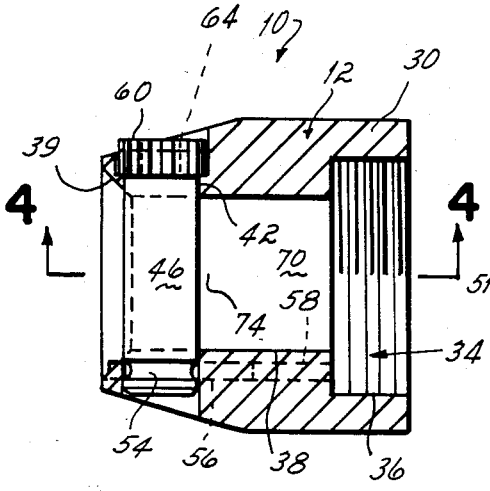
FIG. 3 is a cross sectional view taken on line 3—3 of FIG. 2.
Figure 4:
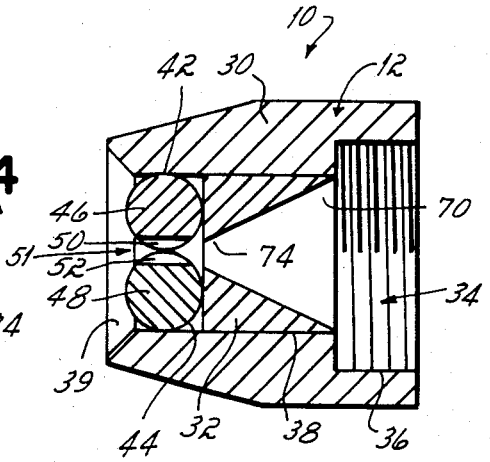
FIG. 4 is a cross sectional view taken on line 4—4 of FIG. 3.
Figure 5:
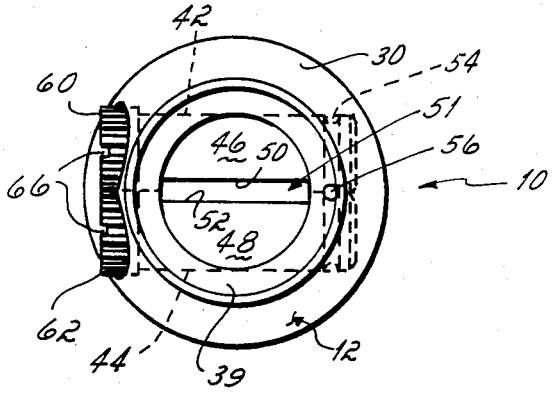
FIG. 5 is a front elevational view of the nozzle assembly of FIG. 1.

The nozzle body 12 comprises an annular collar 30 and a sleeve 32 mounted internally of that collar. With reference to FIGS. 3 and 4, it will be seen that the collar 30 has a stepped axial bore 34 extending therethrough. This bore comprises a large diameter rear end section 36 and a smaller diameter forward end section 38. The small diameter forward end section terminates in an outwardly flaring tapered mouth or discharge orifice 39. The large diameter section 36 is threaded over at least its rearward portion so as to enable the collar to be threaded over the threaded forward end of the barrel 14 and thereby fixedly secured to the barrel.

Extending transversely through the collar of the body 12 on opposite sides of the center line 40, there are a pair of bores 42, 44. A pair of rotatable shafts 46, 48 are mounted within these bores 42, 44. The two shafts are tangential to each other and contacting as may be seen most clearly in FIG. 4. Each shaft 46, 48 has a slot 50, 52 machined or formed in the periphery thereof. These slots 50, 52 are identical in configuration and, in the embodiment illustrated in FIGS. 1–5, are rectangular in configuration. The shafts 46, 48 are positioned so that the slots 50, 52 of the shafts are juxtapositioned to define a rectangular powder flow opening 51 between the two shafts. The shafts 46, 48 are maintained in contacting relationship and preferably in compression against each other so that they seal together except at the opening 51 formed by the oppositely disposed slots 50, 52.

Machined in one end of each shaft 46, 48 there is an annular groove 54. These grooves are adapted to receive an assembly pin 56 mounted within a longitudinally extending bore 58 of the collar 30. The pin 56 is a press fit pin located within the bore 58. This pin functions to retain the shafts within the bores 42, 44 while still permitting rotation of the shafts within the bores. To replace the shafts 46, 48 within the bores, the pin may be knocked out or forced out of the collar and the shafts thereby released for axial removal from the bores 42, 44.

At the end of the shafts 46, 48 opposite from the radiused groove 54, each shaft has a small gear 60, 62 fixedly mounted thereon. This gear may be press fit onto or otherwise secured to a stub shaft 64 on the end of each shaft. A transverse slot 66 extends across the face of each gear 60, 62 and across the face of the stub shaft 64 upon which the gears are mounted. The gears function to rotate both shafts 46, 48 in unison when one of them is turned by a tool, such as a screw driver, inserted into one of the slots 66 in the end of the one of the shafts 46, 48.

With reference now to FIG. 4, it will be seen that the sleeve 32 of the body 12 has a tapered bore 70 formed therein. The upstream end of this bore is annular in configuration and of approximately the same diameter as the bore 16 in the barrel 14. The downstream end 74 of the barrel is of the same configuration as the powder flow opening 51 defined by the slots 50, 52 of the shafts 46, 48. Consequently, the sleeve 32 forms a smooth transition flow path from the circular cross section flow path of the barrel 16 to the rectangular or other configured opening 51 defined by the slots in the two shafts 46, 48. Consequently, there is a smooth flow of air entrained powder through the nozzle assembly 10 and through the powder flow opening 51 defined between the two shafts 46, 48.

Figure 6:
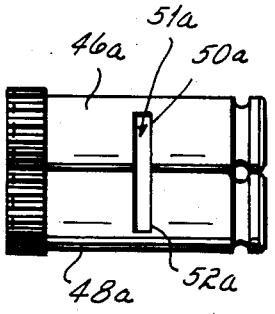
FIG. 6 is an end elevational view of an alternative pair of shafts utilizable in the nozzle of FIG. 1 to change the configuration of powder spray emitted from the nozzle assembly.

With reference now to FIG. 6, there is illustrated a second pair of shafts **46*a*, 48*a* which are identical to the shafts 46, 48 except for the configuration of the slots 50*a*, 52*a* machined therein. In this embodiment, the slots 50*a*, 52*a* form a vertical slot opening 51a rather than a horizontal slot 51 as in the embodiment of FIGS. 1–5. In all other respects the shafts 46*a*, 48*a* are identical to the shafts 46 and 48**.

In order to substitute or change from the shafts 46, 48 in the nozzle assembly 10 to the shafts **46*a*, 48*a*, all that is required is to knock out or remove the pin 56 from the bore 58. With this pin removed, the two shafts may be axially pulled from the bores 42, 44 and the new shafts 46*a*, 48*a* inserted therein. The pin 56 may then be reinserted into the bore 58 so as to secure the shafts 46*a*, 48*a* within the bores 42, 44 respectively. If this substitution is made, then the sleeve 32 will be rotated 90° so as to align the rectangular outlet end 74 of the tapered bore 70 with the vertically oriented opening 51*a* defined between the two shafts 46*a*, 48*a***.

Figure 7:
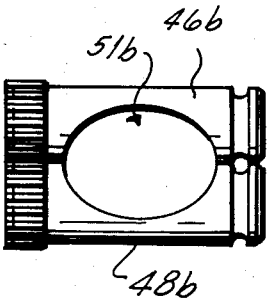
FIG. 7 is a front elevational view of a third pair of shafts utilizable in the nozzle assembly of FIG. 1 to change the configuration of powder spray emitted from the nozzle assembly of FIG. 1.

With reference to FIG. 7 there is illustrated yet a third pair of shafts **46*b*, 48*b* which, except for the opening 51*b* defined therebetween, are identical to the shafts 46, 48. These two shafts define a generally elliptically shaped opening 51*b* therebetween. These shafts could as well be substitued for the shafts 46, 48 so as to convert the powder flow opening defined between the two shafts from a rectangular slot to an elliptical slot. In the event that this substitution is made, then another sleeve 32 would be substituted for the sleeve 32 of the nozzle body so as to conform the downstream end 74 of the tapered bore 70 in the sleeve to the elliptical configuration of the opening 51*b*** defined between the two shafts.

The preferred embodiment of the nozzle assembly 10 has been illustrated and described as being applicable to a spray system for electrostatically spraying powder onto a target substrate. So long as the nozzle assembly 10 is used for electrostatic spraying applications, the nozzle body 12, as well as the shafts 46, 48, gears 60, 62 and sleeve 32 will all be made from non-metallic, electrically insulative materials so as to minimize the electrical capacitance of the nozzle assembly. The reasons for minimizing such electrical capacitance are well known in the art and are fully described in U.S. Pat. No. 3,048,498. On the other hand, the invention is applicable to non-electrostatic powder spray applications, and in that event, the electrode holder 26 and electrode mount 18 will be omitted and the components of the nozzle assembly 10 may be made of metallic or electrically conductive materials.

In the use of the powder spray gun and nozzle assembly depicted in FIGS. 1–5, air entrained powder is supplied under pressure through the bore 16 of the gun barrel 14 to and through the nozzle assembly 10. This air entrained powder is forced to flow through the opening 51 defined by the slots 50, 52 in the periphery of the shafts 46, 48. The air entrained powder emerging from the nozzle assembly thus has the configuration of this slot imparted to it before it expands into a wedge shaped configuration (as indicated at 80 in FIG. 2) upon emergence from the opening 51 of the nozzle assembly. In the event that the wedge is too wide in configuration at the time it strikes a target substrate, the configuration of that powder spray pattern may be altered by rotating one of the shafts 46, 48 and thereby, through the spur gears attached to the ends of the shafts, rotating both. This rotation of the shafts changes the width of the rectangular slot 51. In the case of the elliptical slot 51*b*, the adjustment changes the minor diameter of that slot so as to vary the pattern of powder emerging from the nozzle.

The primary advantage of the invention of this application is that it enables the powder spray pattern emerging from the nozzle assembly to be easily altered or varied. Prior to this invention, it was not possible with prior art powder spray guns and nozzle assemblies to vary to any appreciable degree from a conically shaped powder spray pattern. The invention of this application enables a powder spray gun to spray any one of a multiplicity of patterns and further enables those patterns to be adjusted in width by simply rotating a shaft of the nozzle assembly.

While I have described only three embodiments of my invention, persons skilled in this art will appreciate numerous changes and modifications which may be made without departing from the spirit of my invention. Therefore, I do not intend to be limited except by the scope of the following appended claims:

I claim:

1. An adjustable pattern powder spray nozzle assembly for spraying variable patterns of solid particulate powder material from said assembly of solid particulate powder material from said assembly comprising, a nozzle body having an axial powder flow passage therein, a pair of parallel, transverse bores in said body, said transverse bores intersecting said powder flow passage, a pair of rotatable shafts, one of said rotatable shafts being mounted in each of said transverse bores, said shafts being positioned adjacently one another, a longitudinally extending slot formed in the periphery of each of said shafts, said slots of said shafts being oppositely positioned so as to form a combined powder flow opening therethrough, means for rotating said shafts in unison so as to vary the configuration of said powder flow opening and thereby the patterns of powder emitted from said nozzle assembly, and an electrode mount secured adjacent to said nozzle body, said electrode mount having a powder charging electrode extending from the forward end thereof.

2. A powder spray gun having an adjustable pattern powder spray nozzle for spraying variable patterns of solid particulate powder material from said gun, said gun comprising, a gun barrel having a powder flow path therein, an electrode mount on said barrel, said mount having a powder charging electrode extending from the forward end thereof, a nozzle body mounted on the forward end of said barrel, said nozzle body having an axial powder flow passage aligned with and in communication with said powder flow path of said gun barrel, a pair of parallel, transverse bores in said body, said transverse bores intersecting said powder flow passage, a pair of rotatable shafts, one of said rotatable shafts being mounted in each of said transverse bores, said shafts being located adjacently one another, a longitudinally extending slot formed in the periphery of each of said shafts, said slots of said shafts being oppositely positioned so as to form a combined powder flow opening therethrough, and means for rotating said shafts in unison so as to vary the configuration of said powder flow opening and thereby the pattern of powder emitted from said nozzle assembly.

3. The powder spray gun of claim 2 wherein said axial powder flow passage of said nozzle body terminates in a powder discharge orifice, and said electrode being located in proximity to said powder discharge orifice so that powder discharged from said orifice may be electrostatically charged by said electrode.

4. The powder spray gun assembly of claim 2 wherein said nozzle body comprises a collar adapted to be secured onto the end of a powder spray gun and a sleeve mounted internally of said collar, said axial powder flow passage in said body extending through said sleeve and being tapered inwardly from the upstream to the downstream end of said sleeve.

5. The powder spray gun assembly of claim 2 wherein said axial powder flow passage in said body terminates at one end in a discharge orifice, said passage being tapered outwardly from adjacent said pair of rotatable shafts to said discharge orifice.

6. The powder spray gun assembly of claim 2 wherein said means for rotating said shafts in unison comprises a pair of gears fixedly attached to the ends of said shafts.

7. The powder spray gun assembly of claim 2 wherein said shafts are secured against axial movement in said nozzle body by a single locating pin mounted in said nozzle body, said locating pin extending into annular grooves in the periphery of both of said shafts.

8. An adjustable pattern powder spray nozzle assembly for spraying variable patterns of solid particulate powder material from said assembly comprising, a nozzle body having an axial powder flow passage therein, a pair of parallel, transverse bores in said body, said transverse bores intersecting said powder flow passage, a pair of rotatable shafts, one of said rotatable shafts being mounted in each of said transverse bores, said shafts being positioned adjacently one another, a longitudinally extending slot formed in the periphery of each of said shafts, said slots of said shafts being oppositely positioned so as to form a combined powder flow opening therethrough, means for rotating said shafts in unison so as to vary the configuration of said powder flow opening and thereby the pattern of powder emitted from said nozzle assembly, and said shafts being secured against axial movement in said nozzle body by a single locating pin mounted in said body, said locating pin extending into annular grooves in the periphery of both of said shafts.

* * * * *